US007301086B2

(12) United States Patent
Ito

(10) Patent No.: US 7,301,086 B2
(45) Date of Patent: Nov. 27, 2007

(54) TAILPIECE OF A STRINGED MUSICAL INSTRUMENT

(75) Inventor: Osamu Ito, Hamamatsu (JP)

(73) Assignee: Yamaha Corporation, Shizuoka (JP)

( * ) Notice: Subject to any disclaimer, the term of this patent is extended or adjusted under 35 U.S.C. 154(b) by 107 days.

(21) Appl. No.: 11/027,840

(22) Filed: Dec. 29, 2004

(65) Prior Publication Data

US 2005/0150348 A1 Jul. 14, 2005

(30) Foreign Application Priority Data

Jan. 8, 2004 (JP) ..... 2004-003099

(51) Int. Cl.
*G10D 3/04* (2006.01)

(52) U.S. Cl. ..... 84/299; 84/298; 84/307

(58) Field of Classification Search ..... 84/298, 84/299, 307

See application file for complete search history.

(56) References Cited

U.S. PATENT DOCUMENTS

| | | | | | |
|---|---|---|---|---|---|
| 897,964 | A * | 9/1908 | De Julio | 84/298 |
| 2,082,951 | A * | 6/1937 | Grover | 84/298 |
| 2,714,326 | A * | 8/1955 | McCarty | 84/299 |
| 4,031,799 | A * | 6/1977 | Fender | 84/307 |
| 4,069,733 | A * | 1/1978 | Quan | 84/299 |
| 4,171,661 | A * | 10/1979 | Rose | 84/313 |
| D256,132 | S * | 7/1980 | Wilson | D17/21 |
| D261,527 | S * | 10/1981 | Carson | D17/21 |
| D265,835 | S * | 8/1982 | Rickard | D17/21 |
| 4,625,613 | A * | 12/1986 | Steinberger | 84/298 |
| 5,347,905 | A * | 9/1994 | Cipriani | 84/298 |
| 5,481,956 | A * | 1/1996 | LoJacono et al. | 84/314 N |
| 5,503,054 | A * | 4/1996 | Ellsworth et al. | 84/307 |
| 5,750,910 | A * | 5/1998 | LoJacono | 84/314 N |
| 6,124,536 | A * | 9/2000 | Hoshino | 84/298 |
| 6,137,039 | A * | 10/2000 | Rose | 84/298 |
| 6,613,968 | B1 * | 9/2003 | Devereaux et al. | 84/299 |
| 6,765,137 | B2 * | 7/2004 | Smart | 84/313 |
| 6,870,083 | B2 * | 3/2005 | Turner | 84/298 |
| 6,875,910 | B2 * | 4/2005 | Naimish | 84/298 |
| 2004/0134329 | A1 * | 7/2004 | Turner | 84/298 |
| 2004/0134330 | A1 * | 7/2004 | Braun et al. | 84/298 |

(Continued)

FOREIGN PATENT DOCUMENTS

| | | |
|---|---|---|
| JP | 45-30382 | 11/1970 |

(Continued)

*Primary Examiner*—Lincoln Donovan
*Assistant Examiner*—Robert W. Horn
(74) *Attorney, Agent, or Firm*—Koda & Androlia

(57) ABSTRACT

A tailpiece of, for instance, an electric guitar including a bridge main body attached to the guitar main body by two protruding stud screws so as to be moved and adjusted in the direction of the stretched strings. At both ends of the bridge main body, first and second string supports for supporting first and sixth strings are formed integrally to protrude inwardly. Between the first and second string supports, a first bridge saddle member for supporting the second and third strings, and a second bridge saddle member for supporting the fourth and fifth strings, are provided. These saddles are connected to the bridge main body by saddle adjustment screws so as to be moved and adjusted in the forward and backward direction. The first and second bridge saddle members are moved along the surfaces parallel to the direction of the stretched strings.

8 Claims, 6 Drawing Sheets

U.S. PATENT DOCUMENTS

| | | | | |
|---|---|---|---|---|
| 2005/0045018 | A1* | 3/2005 | Turner | 84/298 |
| 2005/0150348 | A1* | 7/2005 | Ito | 84/299 |
| 2006/0042449 | A1* | 3/2006 | Chang | 84/298 |
| 2007/0095192 | A1* | 5/2007 | Moore | 84/298 |

FOREIGN PATENT DOCUMENTS

| | | |
|---|---|---|
| JP | 59-112296 | 7/1984 |
| JP | 63-19896 | 2/1988 |
| JP | 5-84992 | 11/1993 |
| JP | 7-56558 | 3/1995 |
| JP | 10-149155 | 6/1998 |

* cited by examiner

TAILPIECE OF A STRINGED MUSICAL INSTRUMENT

BACKGROUND OF THE INVENTION

1. Technical Field

The present invention relates to a tailpiece (or a bridge) for a stringed musical instrument and more particularly to a tailpiece of an electric guitar.

2. Description of the Related Art

In a stringed musical instrument, for instance, an electric guitars, strings are installed so that one end (tip end) of each string is fastened to a tuning peg of the head and the other end (base end) is fastened to a tailpiece provided on the surface of the guitar main body, and these strings are provided under prescribed tensions on the top surface of the guitar main body.

The tailpiece generally comprises a bridge main body attached to the guitar main body, a bridge saddle member (a string supporting member) attached to this bridge main body and supports the base ends of the strings, a length adjusting means for moving and adjusting the bridge saddle member in the direction of the length of the stretched strings (or in the forward and backward direction of the guitar main body), and a height adjusting means for moving and adjusting the bridge saddle member in its height direction. By moving and adjusting the bridge saddle member in the forward and backward direction (or in the direction of the length of the stretched strings), and the angles between the effective string length of the strings and the base ends of the strings are changed, so that the tunes and intonations (sound tones) are adjusted.

Such a tailpiece as above described is disclosed in, for instance, Japanese Patent Application Laid-Open (Kokai) No. H10-149155 and in Japanese Utility Model Application Laid-Open (Kokai) No. H5-84992.

The bridge (tailpiece) of an electric guitar described in Japanese Patent Application Laid-Open (Kokai) No. H10-149155, as illustrated in the accompanying FIGS. 10 and 11, is comprised of a bridge base 4 secured by a plurality of screws 3 to the surface of an electric guitar main body 2, six (6) bridge main bodies (string supporting members) 6 provided on the bridge base 4 so that they can be moved and adjusted in the direction of the stretched strings 5*a* to 5*d* (the direction being in the right and left direction in FIGS. 10 and 11), height adjustment screws 7 for supporting the bridge main bodies 6 thereon so that the bridge main bodies 6 are adjusted for height, and adjustment screws 9 which connect the bridge main bodies 6 to the bridge base 4 so that the bridge main bodies 6 are moved and adjusted in the forward and backward direction (which is in the right and left direction in FIGS. 10 and 11).

The tailpiece of a stringed musical instrument described in Japanese Utility Model Application Laid-Open (Kokai) No. H5-84992, as illustrated in the accompanying FIGS. 12 and 13, is secured to the body 2 of a stringed musical instrument, and bridges (string supporting members) 12 that support base end portions of the strings 4 and string point-anchoring sliders 9 that secures the base end portions of the strings 4 are provided in the tailpiece 6 so that the bridges 12 can each be moved and adjusted in the forward and backward direction along guide channels 8 so that the string slant angles α of the segments 4' of the strings 4 that are between the bridges 12 and the string points of the string point-anchoring sliders 9 can be changed by moving and adjusting the string point-anchoring slides 9 forward and backward prior to adjustment of the strings 4.

However, all conventional stringed musical instruments or electric guitars have several problems and thus have room for improvement.

In the electric guitar bridge disclosed in Japanese Patent Application Laid-Open (Kokai) No. H10-149155, as seen from FIGS. 10 and 11, the bridge main bodies 6 are supported by the left and right height adjustment screws 7, and the height adjustment screws 7 are moved in the channels 10 formed in the bridge base 4 by turning the adjustment screws 9. Consequently, the area of surface contact between the height adjustment screws 7 and the channels 10 is small, and in addition two adjustment screws are not provided so that they are at positions which are left-and-right symmetrical with the strings 5 (5*a* through 5*e*). As a result, the movements of the bridge main bodies 6 tend to be unstable. Furthermore, since the adjustment screws 9 are provided so that they are shifted to one side to avoid contact with the strings, when the bridge main bodies 6 tilt, then the left and right height adjustment screws 7 cannot be moved smoothly.

In addition, because the adjustment screws 9 for the bridge main bodies 6 are formed with Phillips-head grooves in their heads, when adjustments are made, unless the shaft of a screwdriver is sufficiently long, the shaft of the screwdriver is butted against the guitar main body, thus making it difficult to operate the screwdriver. There is also the possibility that the screw heads are striped if the screwdriver tilts during the use.

In the tailpiece of a stringed musical instrument described in Japanese Utility Model Application Laid-Open (Kokai) No. H5-84992, as seen from FIGS. 12 and 13, when the string point-anchoring sliders 9 are moved in the forward and backward direction to change the string slant angle α, movement and adjustment thereof must be done by hand after loosening, from above the string segments 4', the fastening screws 11 which secure the string point-anchoring sliders 9 to the tailpiece unit 6. Thus, adjustments with the strings 4 tensioned cannot be done, which poses a problem. For this reason, it is necessary to loosen and then adjust the strings 4. However, after loosening the fastening screws 11 and moving and adjusting the string point-anchoring sliders 9 in the forward and backward direction, a desired tuning and intonation is still not necessarily be realized with one adjustment action in which the fastening screws 11 are tightened and the strings 4 are re-tensioned. Thus, the problem is that sometimes the string point-anchoring sliders 9 must be repeatedly moved and adjusted. In FIGS. 12 and 13, the reference numeral 2 is a guitar main body, 6 is a bridge, and 8 is a sliding groove formed in the bridge 6.

BRIEF SUMMARY OF THE INVENTION

Accordingly, the present invention is to solve the problems described above, and an object of the present invention is to provide a tailpiece of a stringed musical instrument such as an electric guitar in which bridge saddle members are moved and adjusted smoothly.

It is another object of the present invention to provide a tailpiece of a stringed musical instrument in which the manipulability of the saddle adjusting means is enhanced.

The above objects are accomplished by a unique structure of the present invention for a tailpiece of a stringed musical instrument for securing base ends of stretched strings on a stringed musical instrument main body, and in the present invention, the tailpiece comprises:

a bridge main body provided on the stringed musical instrument main body so as to be movable in a direction of the stretched strings, a plurality of bridge saddle members provided on the bridge main body for supporting the stretched strings, and a saddle adjusting means for moving and adjusting the bridge saddle members in the direction of the stretched strings; and each of the bridge saddle members is in contact with an adjacent bridge saddle member and the bridge main body in a plane that is parallel to the direction of the stretched strings, and the saddle adjusting means is provided on said main body, the saddle adjusting means, upon being turned, moves and adjusts the bridge saddle members in the direction of the stretched strings along the surface of contact between the adjacent bridge saddle member and bridge main body.

In the above structure, the saddle adjusting means is a screw that is formed therein a hexagonal groove.

In the tailpiece of a stringed musical instrument of the present invention, mutually adjacent bridge saddle members are in contact with each other in a parallel plane in the direction of the stretched strings and also in contact, in the same manner, with the bridge main body in planes that are parallel with the direction of the stretched strings. Accordingly, the bridge main body can be moved in stable manner and smoothly with these planes acting as guide surfaces.

If an L-shaped hexagonal wrench is used to turn and adjust the saddle adjusting means that are screws having hexagonal grooves therein, such screws can be turned without requiring great force, and the wrench can be turned roughly 180° in a direction perpendicular to the stretched strings on the stringed musical instrument main body.

DETAILED DESCRIPTION OF THE INVENTION

The present invention will be described below with reference to the embodiments shown in the accompanying drawings.

Figure 1A:
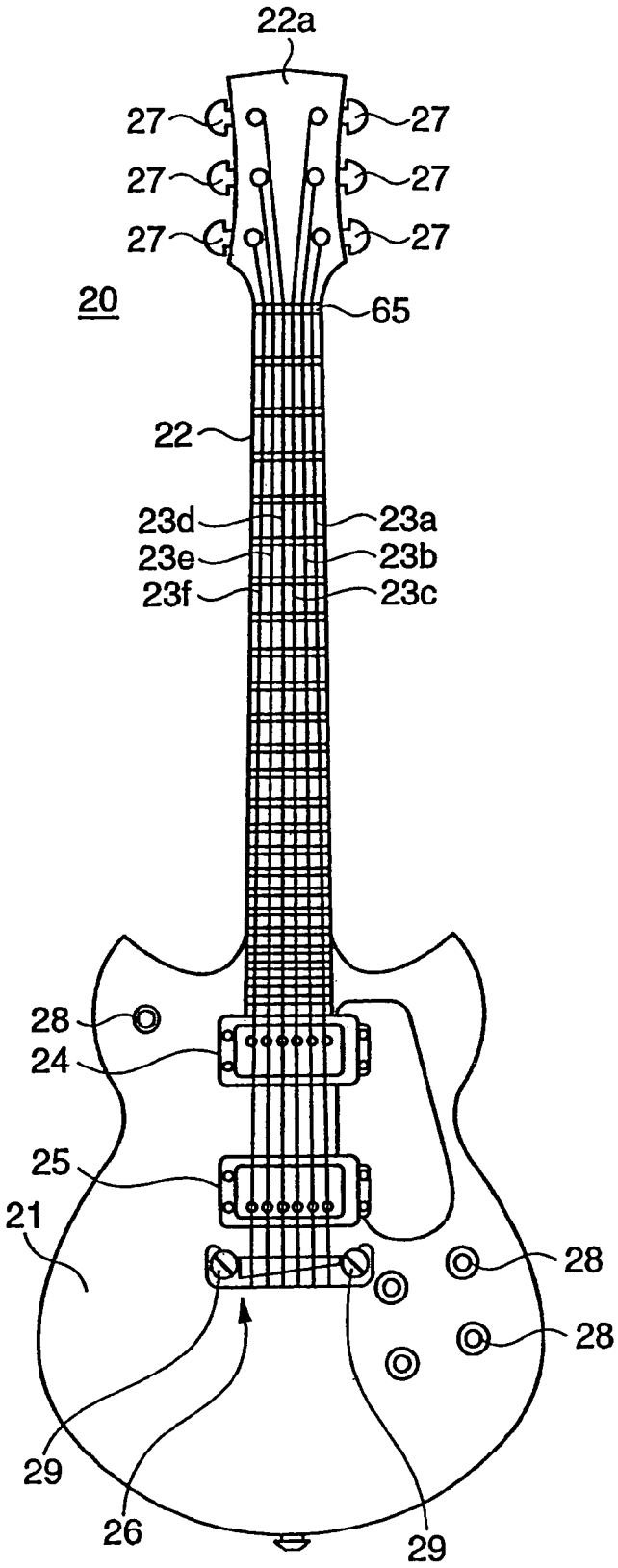
FIG. 1(*a*) is a front view of the electric guitar equipped with a tailpiece according to the present invention, and FIG. 1(*b*) is a side view thereof.
Figure 1B:
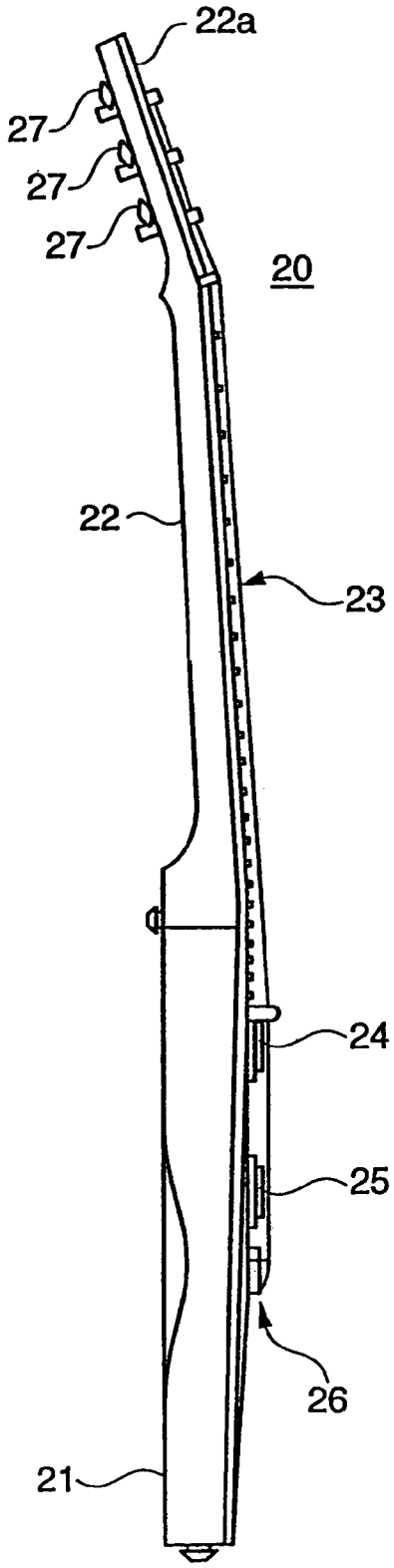

In FIGS. 1(*a*) and 1(*b*), a stringed musical instrument such as an electric guitar 20 comprises a solid guitar main body 21, a neck 22 attached to the front end of the guitar main body 21, pickup units 24 and 25 provided in the width-wise central portion on the surface of the guitar main body 21 for converting the vibrations of six strings 23 (23*a* to 23*f*), respectively, to electrical signals, a tailpiece 26 provided on the surface of the guitar main body 21 for supporting and securing the body-side ends (or root ends) of the strings 23, tuning pegs 27 installed in the head 22*a* of the neck 22 for securing the neck-side ends (or the tip ends) of the strings 23, and various kinds of switches 28 provided on the surface of the guitar main body 21.

Behind (or in the back of) the pickup unit 25, a pair of stud screws 29 for securing the tailpiece 26 to the guitar main body 21 are provided so that the stud screws 29 erect at left-and-right symmetrical positions on either side of the (imaginary) centerline in the width direction of the guitar main body 21.

Figure 6:
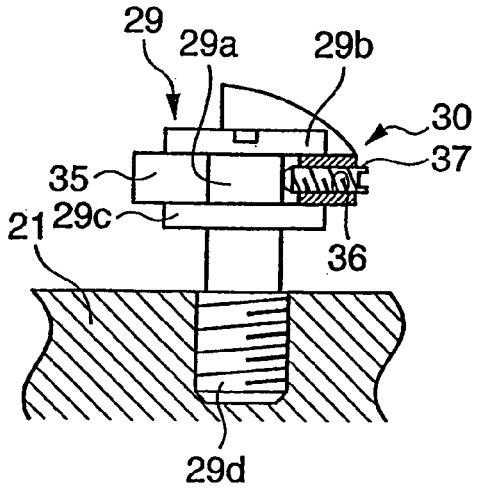
FIG. 6 is a cross-sectional view taken along the line 4-4 in FIG. 2.

As seen from FIG. 6, each of the stud screws 29 is comprised of a cylindrical portion 29*a*, a pair of (upper and lower) collar portions 29*b* and 29*c* formed in the cylindrical portion 29*a*, and an externally threaded portion 29*d* formed in the lower end of the cylindrical portion 29*a* so that it screws into the guitar main body 21.

The tailpiece 26 is comprised, as seen from FIGS. 2 to 9, of a bridge main body 30 which, by the tension of the strings 23, is pressed against the stud screws 29.

The bridge main body 30 is made of a metal (ZnDC, for example) and in a rectangular shape with its longer sides in the direction perpendicular to the direction of the stretched strings 23. First and second attachment portion 32A and 32B are respectively provided at both ends of the bridge main body 30 so that that the first and second attachment portions 32A and 32B face the stud screws 29. On the inner sides of the first and second attachment portions 32A and 32B, first and second string supports 33*a* and 33*b* are formed so as to protrude inwardly. The string supports 33*a* and 33*b* respectively support the body-side ends of the first string (high pitch string) 23*a* and the sixth string (low pitch string) 23*f* of the six strings 23.

Figure 2:
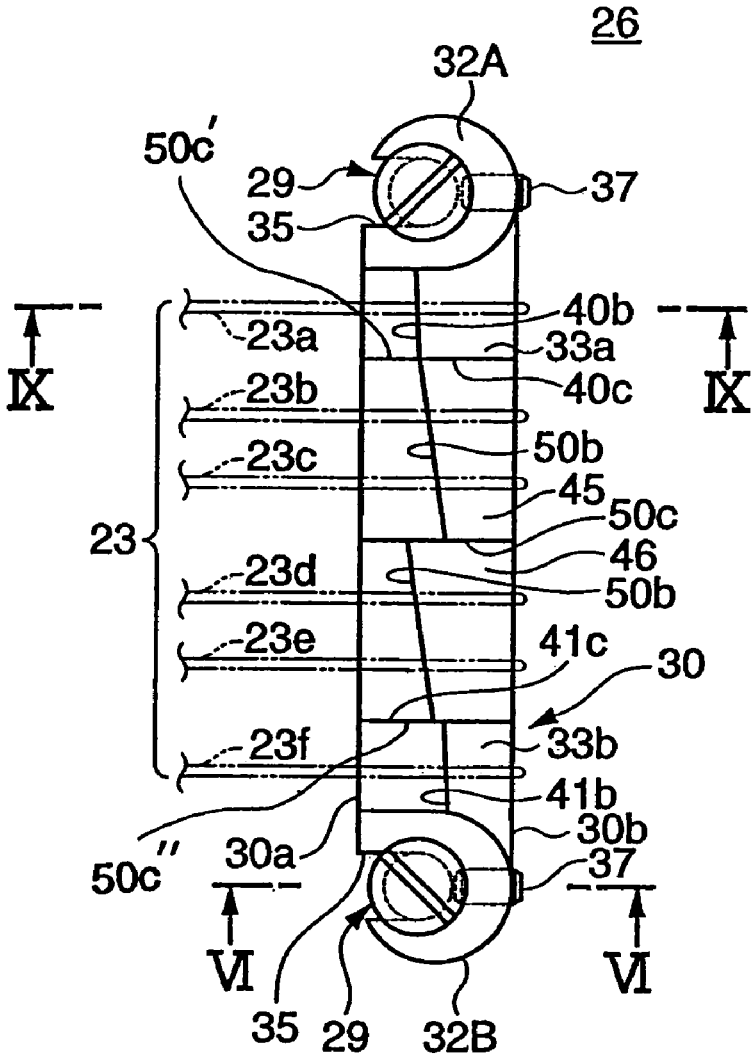
FIG. 2 is a top view of the tailpiece.
Figure 7:
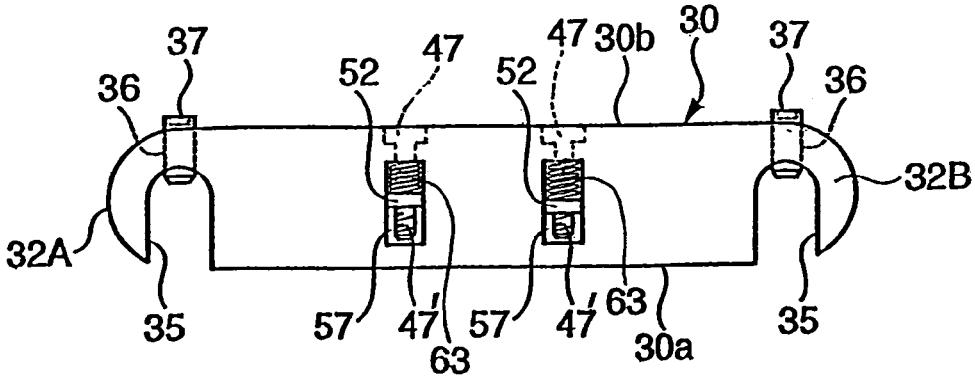
FIG. 7 is a bottom view of the tailpiece.

As seen from FIGS. 2 and 7, the first and second attachment portions 32A and 32B are respectively formed in a U shape when seen from above, and they have U-shaped openings 35 which are open on the front surface 30*a* side of the bridge main body 30. These U-shaped openings 35 are engaged with the cylindrical portions 29*a* of the stud screws 29.

In the back surface of the first and second attachment portions 32A and 32B, as seen from FIG. 6, threaded holes 36, which pass through the U-shaped openings 35, respectively, are formed. Into these threaded holes 36, bridge adjustment screws 37 for moving and adjusting the bridge main body 30 in the direction of the stretched strings 23 are screwed in from the rear side. The tip ends of the bridge adjustment screws 37 protrude into the U-shaped openings 35 and butt against the cylindrical portions 29*a* of the stud screws 29. Screws having hexagonal grooves therein (hex screws) are used for the bridge adjustment screws 37, and the bridge adjustment screws 37 are manipulated to be turned by, for instance, an L-shaped wrench at a located away from the tuning pegs 27.

Figure 9:
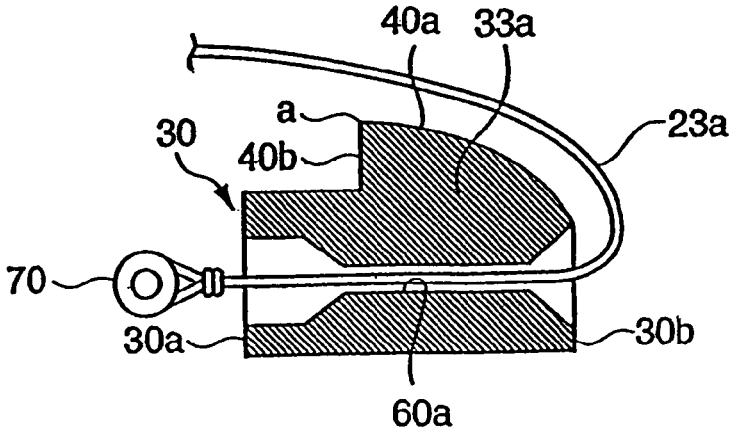
FIG. 9 is a cross-sectional view taken along the line 9-9 in FIG. 2.
Figure 10:
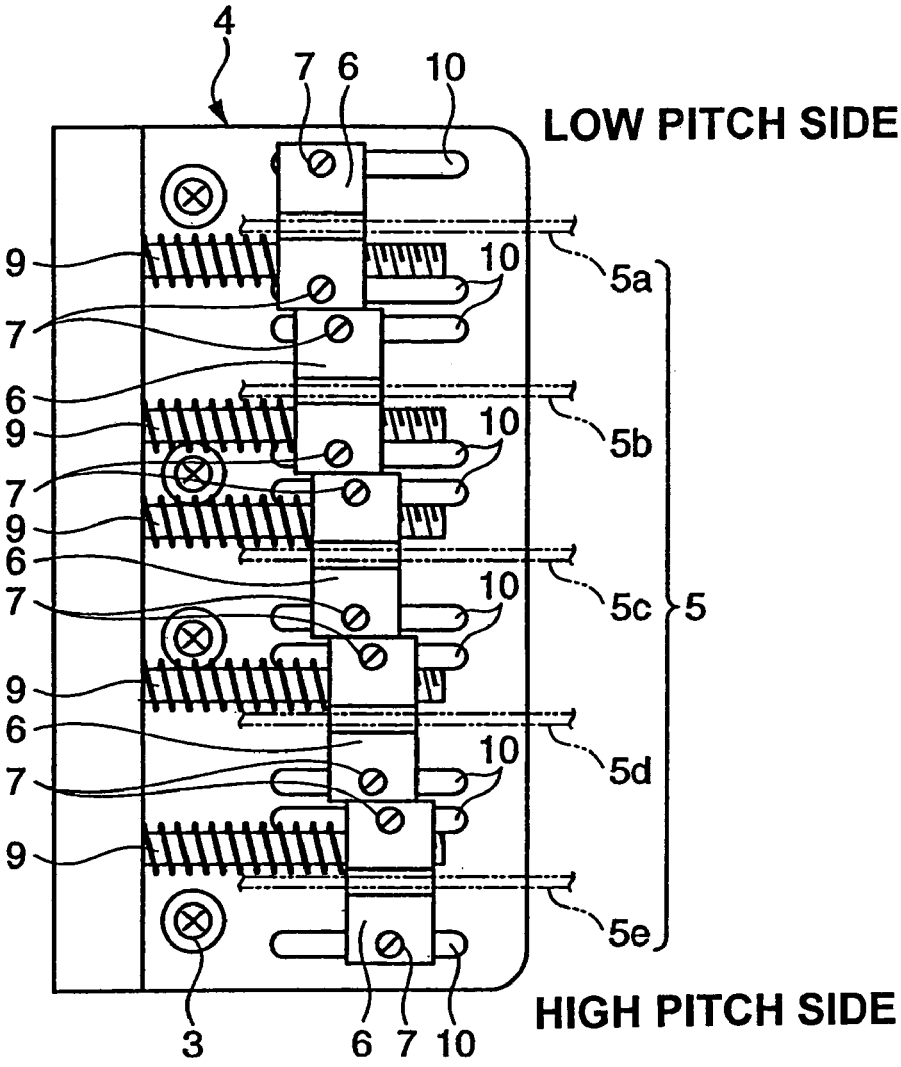
FIG. 10 PRIOR ART
FIG. 10 is a top view of a conventional bridge structure.
Figure 11:
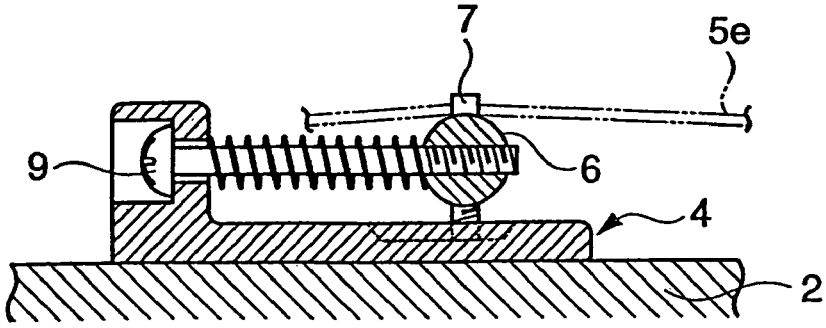
FIG. 11 PRIOR ART
FIG. 11 shows the cross-section of the bridge structure of FIG. 10.
Figure 12:
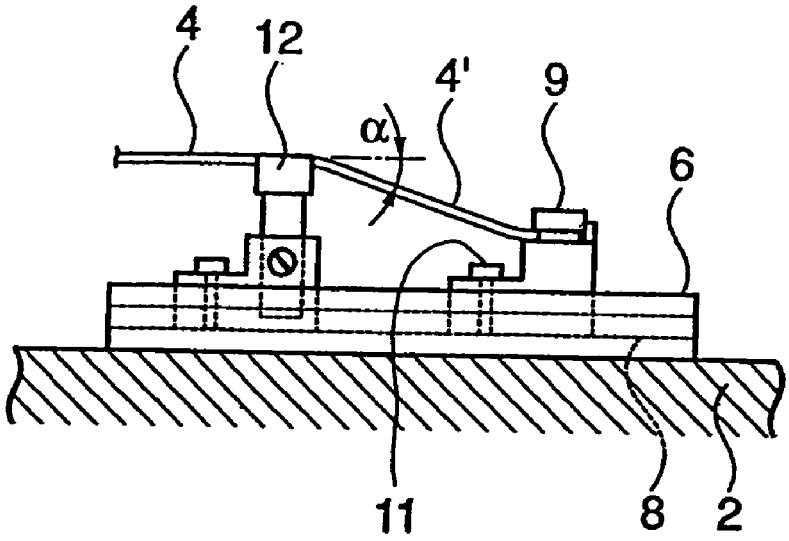
FIG. 12 PRIOR ART
FIG. 12 is a side view of another conventional bridge structure.
Figure 13:
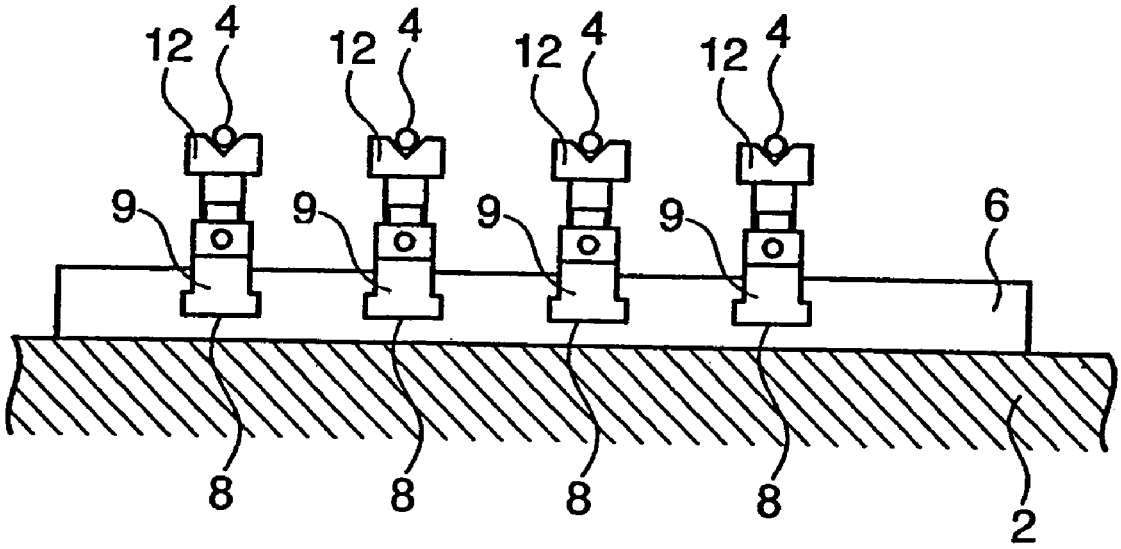
FIG. 13 PRIOR ART
FIG. 13 is a rear view of the bridge structure of FIG. 12.

The above-described first string support 33*a* is, as shown in FIG. 9, a protruding body that comprises a convex upper surface 40*a*, which gradually slants downward toward the back, and a perpendicular front surface 40*b*. The first string support 33*a* further includes an inner wall surface 40*c* (see FIG. 2) that is a perpendicular surface parallel to the direction of the stretched strings 23.

Figure 3:
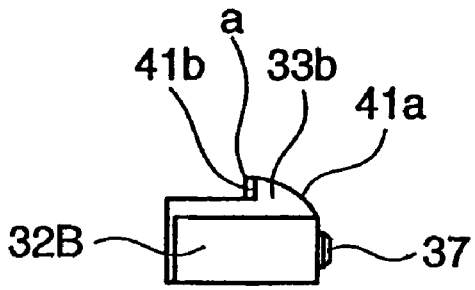
FIG. 3 is a side view of the tailpiece.

The second string support 33*b* has substantially the same structure as the first string support 33*a*; and it is, as seen from FIG. 3, a protruding body that comprises a convex upper surface 41*a*, which gradually slants downward toward the back, and a perpendicular front surface 41*b*. The second string support 33*b* further includes an inner wall surface 41*c* (see FIG. 2) that is a perpendicular surface parallel to the direction of the stretched strings 23.

The difference between the first string support 33*a* and the second string support 33*b* is, as seen from FIG. 2, that the front surface 40*b* of the first string support 33*a* is positioned further toward the front than the front surface 41*b* of the second string support 33*b*. Another difference between the first and second string supports 33*a* and 33*b* is that the front surface 40*b* of the first string support 33*a* is substantially at right angles with respect to the direction of the stretched strings 23 while the front surface 41*b* of the second string support 33*b* is slanted so as to be inclined to the low pitch side relative to the direction of the stretched strings 23. As a result, the string end on the low pitch side is positioned further toward the back than the string end on the high pitch side.

The upper corner edges a of the front ends of the first and second string supports 33*a* and 33*b* (or the upper edges of the front surfaces 40*b* and 41*b*, see FIG. 3 and FIG. 9) respectively form string support points for the first and sixth strings 23*a* and 23*f*.

On the upper surface of the above-described bridge main body 30 and between the first and second string supports 33*a* and 33*b*, a recess 44 is formed; and in this recess 44, a first bridge saddle member 45 for supporting the body-side ends of the second and third strings 23*b* and 23*c* and a second bridge saddle member 46 for supporting the body-side ends of the fourth and fifth strings 23*d* and 23*e* are provided. These bridge saddle members 45 and 46 are connected to the bridge main body 30 by saddle adjustment screws 47 so that the bridge saddle members 45 and 46 are respectively movable and adjustable in the forward and backward direction (or in the direction of the stretched strings).

The recess 44 is comprised of a bottom surface 44*a* (see FIG. 5), which is parallel to the direction of the stretched strings 23 (or parallel to the surface of the guitar main body 21), and the above-described inner wall surfaces 40*c* and 41*c*, which are perpendicular to the surface of the guitar main body 21.

The first and second bridge saddle members 45 and 46 are formed in substantially the same shape, and they are made of the same metal material as that of the bridge main body 30. As seen from FIG. 8, the first and second bridge saddle members 45 and 46 are respectively comprised of a main portion 50, a flat plate portion 51 extending forward from the main portion 50, and a leg portion 52 that projects downward from the lower surface where the flat plate portion 51 extends.

Figure 8:
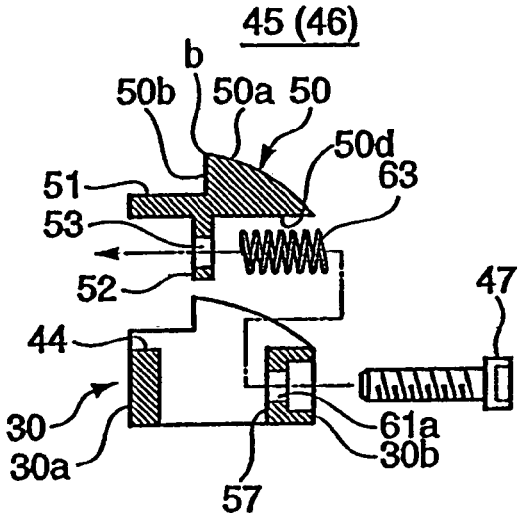
FIG. 8 is an exploded sectional view of the tailpiece.

The main portion 50 of each of the first and second bridge saddle members 45 and 46 is in substantially a triangular shape in cross-section as seen from FIG. 8, and it is comprised of a convex upper surface 50*a* that gradually slants downward toward the back of the main portion, a perpendicular front surface 50*b*, left and right side surfaces 50*c* (see FIG. 5) which are perpendicular surfaces parallel to the direction of the stretched strings 23, and a horizontal bottom surface 50*d*. The leg portion 52 of each one of the saddles 45 and 46 is formed with a threaded bore 53, and the threaded shank portion 47' of the saddle adjustment screw 47 is screwed into this threaded bore 53. The front surface 50*b* of each one of the bridge saddle members 45 and 46 is, as seen from FIG. 2, slanted with reference to the direction of the stretched strings 23 so that one side, which is on the lower pitch string (23*c*, 23*e*) side, of each one of the bridge saddle members 45 and 46 is located behind the other side, which is on the higher pitch string (23*b*, 23*d*) side, of each bridge saddle member.

The first bridge saddle member 45 and the second bridge saddle member 46 are both provided in the recess 44 of the bridge main body 30 with their side surfaces 50*c*, which face each other, in contact. The outer side surface 50*c'* of the first bridge saddle member 45, which is on the opposite side from the second bridge saddle member 46, makes contact with the inner wall surface 40*c* of the first string support 33*a*, and the outer side surface 50*c"* of the second bridge saddle member 46, which is on the opposite side from the first bridge saddle member 45, makes contact with the inner wall surface 41*c* of the second string support 33*b*.

The bottom surface 50*d* of each of the first and second bridge saddle members 45 and 46 is in contact with the bottom surface 44*a* of the recess 44 of the bridge main body 30.

The difference between the first and second bridge saddle members 45 and 46 is that, as seen from FIG. 2, the front surface 50*b* of the first bridge saddle member 45 is positioned rearward of the front surface 40*b* of the first string support 33*a* while the front surface 50*b* of the second bridge saddle member 46 is positioned forward of the front surface 41*b* of the second string support 33*b*. The corner edge b (see FIG. 8) on the front upper end of each of the first and second bridge saddle members 45 and 46 forms a string support point for the second to fifth strings 23*b* to 23*e*. Since the string support point b of the first bridge saddle member 45 is positioned further toward the back of the string support point a of the first string support 33*a*, the first bridge saddle member 45 needs to move more in the rear direction than in the forward direction. On the other hand, since the string support point b of the second bridge saddle member 46 is positioned further toward front of the string support point a of the second string support 33*b*, the second bridge saddle member 46 needs to move more in the forward direction than in the rear direction. Thus, the range of movement and adjustment for the first bridge saddle member 45 is set greater in the backward direction than in the forward direction, and the range of movement and adjustment for the second bridge saddle member 46 is set greater in the forward direction than in the backward direction.

As seen from FIGS. 7 and 8, in the bottom surface of the recess 44 of the bridge main body 30, two rectangular holes 57 are formed so that the longer sides are parallel to the forward and backward direction. The rectangular holes 57 penetrate through the bridge main body 30 and open in the bottom surface of the bridge main body 30. Into these rectangular holes 57, the leg portions 52 of the first and second bridge saddle members 45 and 46 are inserted.

Figure 4:
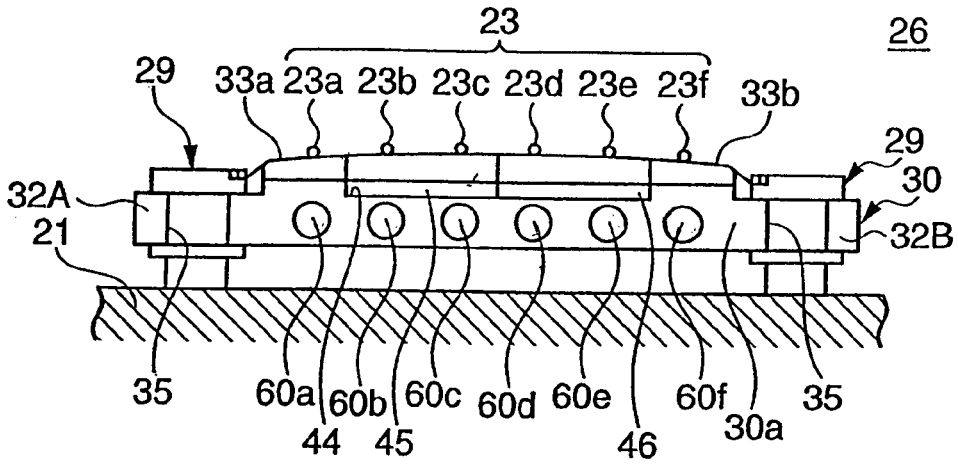
FIG. 4 is a front view of the tailpiece.
Figure 5:
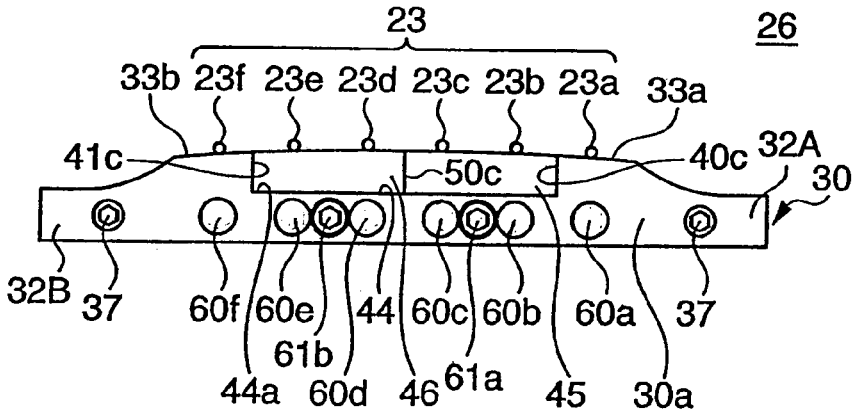
FIG. 5 is a rear view of the tailpiece.

Moreover, as seen from FIGS. 4 and 5, in the bridge main body 30, six string holes 60*a* to 60*f* are formed so that the strings 23*a* to 23*f* are respectively inserted into the string holes 60*a* to 60*f*. These string holes 60*a* to 60*f* are through-holes, and they open in the front and back surfaces 30*a* and 30*b* of the bridge main body 30 as best seen from FIG. 9 that shows the string hole 60*a*. As shown in FIG. 5, the string hole 60*a* is provided in the lower position of the first string support 33*a*, the string holes 60*b* and 60*c* are provided below the first bridge saddle member 45, the string holes 60*d* and 60*e* are provided below the second bridge saddle member 46, and the string hole 60*f* is provided in the lower position of the second string support 33*b*.

Furthermore, as seen from FIG. 8, threaded attachment holes 61*a* and 61*b* are formed in the back surface 30*b* of the bridge main body 30 so as to be positionally correspond to the threaded bores 53 of the first and second bridge saddle members 45 and 46, respectively, and the saddle adjustment screws 47 (particularly their threaded shank portions 70') are inserted into the threaded attachment holes 61*a* and 61*b*. The saddle adjustment screws 47 connect the bridge saddle members 45 and 46 to the bridge main body 30 by being screwed into the threaded bores 53 of the bridge saddle members 45 and 46 from the threaded attachment holes 61*a* and 61*b* through compression coil springs 63. As a result, the first and second bridge saddle members 45 and 46 can be moved and adjusted forward when the saddle adjustment screws 47 are tightened, and, conversely, are moved and adjusted backward when the saddle adjustment screws 47 are loosened.

The saddle adjustment screws 47 have hexagonal grooves therein (or in the head) and are turned by an L-shaped wrench. The compression coil springs 63 urge the first and second bridge saddle members 45 and 46 in the forward direction to prevent play in the forward/backward direction that is caused by backlash in the saddle adjustment screws 47.

Each one of the above-described strings 23*a* to 23*f* has, as shown in FIG. 9, an end ring 70 that is attached to the body-side end of each string. When installing the strings, the neck-side ends of the strings are respectively inserted into the six string holes 60*a* to 60*f* of the bridge main body 30, from the open ends on the front side thereof, and pulled to the back surface 30*b* side. Then, the strings are folded back in the forward direction and laid over the upper surfaces of the first string support 33*a*, over the upper surfaces of the first and second bridge saddle members 45 and 46 and over the upper surfaces of the second string support 33*b*. The strings are passed on the neck 22, and their neck-side ends are respectively wound and secured by the tuning pegs 27 of the head 22*a*. The strings are thus stretched under desired tension.

In the electric guitar 20 structured as described above, when the neck-side ends of the strings 23 are wound up by the tuning pegs 27, the tension of the strings 23 gradually increases, and the tuning and intonation are adjusted. When the strings 23 are tensioned, the tension of the strings urges the bridge main body 30 in the forward direction, and the pair of right-and-left bridge adjustment screws 37 are pressed against the cylindrical portions 29*a* of the stud screws 29 from the behind. As a result, the bridge main body 30 is secured in a stable fashion with respect to the pair of stud screws 29.

When adjusting the timbre and intonation of the electric guitar 20, the left and right bridge adjustment screws 37 are turned by an L-shaped wrench, while tuning (the intonations of) the first and sixth strings 23*a* and 23*f*, thus causing the bridge main body 30 to move forward or backward. The effective string lengths of the strings 23*a* to 23*f*, that is, the lengths of the string segments between the tailpiece 26 and an upper piece (i.e. nut) 65 provided at the tip end of the neck 22, are thus changed, and tuning and intonation are adjusted.

Next, when the saddle adjustment screws 47 are likewise turned by an L-shaped wrench in the tightening or loosening direction so as to move the first and second bridge saddle members 45 and 46 in the forward or backward direction, the effective string lengths of the second to fifth strings 23*b* to 23*e* are changed, and fine adjustments of such strings are accomplished.

In this case, when the bridge adjustment screws 37 and the saddle adjustment screws 47 are turned on the back surface side of the bridge main body 30, in conjunction the turning, the bridge main body 30 and the first and second bridge saddle members 45 and 46 are moved in the forward/backward direction, and there is no need to move them by hand, and the strings 23 are adjusted while they are tensioned. Thus, the adjustment of the strings is simple and easy and can be done in a short time.

Furthermore, because the first and second bridge saddle members 45 and 46 are moved and adjusted in the direction of the stretched strings 23 with the bottom surface 44*a* of the recess 44 and the left and right inner wall surfaces 40*c* and 41*c* being used as guide surfaces, the first and second bridge saddle members 45 and 46 can be moved in a stable fashion and smoothly without, for instance, being tilted.

In the present invention, since screws that have hexagonal grooves are used for the bridge adjustment screws 37 and saddle adjustment screws 47, and they are turned by an L-shaped wrench, strong force for turning such screws is not required compared to ordinary Phillips-head or slot-headed screws. In addition, since the screws 37 and 47 can be turned substantially 180° in a direction perpendicular to the direction of the stretched strings on the guitar main body, the adjustment operation can be done easily.

Furthermore, in the present invention, the body-side ends of the first and sixth strings 23*a* and 23*f* are supported by the first and second string supports 33*a* and 33*b* which are inwardly protruding and integrally formed in the bridge main body 30, and the body-side ends of the second to fifth strings 23*b* to 23*e* are supported by the first and second bridge saddle members 45 and 46. Accordingly, it is not necessary to provide a bridge saddle member for each string, and thus the number of bridge saddle members is one third of prior art tailpiece. In addition, the tailpiece can be manufactured at a low cost, and the external appearance of the tailpiece can be more elegant than prior art tailpiece.

The invention claimed is:

1. A tailpiece of a stringed musical instrument for securing ends of stretched strings on a stringed musical instrument main body, said tailpiece comprising:

a bridge main body provided on said stringed musical instrument main body so as to be movable in a direction of said stretched strings, a plurality of bridge saddle members provided on said bridge main body for supporting said stretched strings, and a saddle adjusting means for moving and adjusting said bridge saddle members in said direction of said stretched strings; wherein each of said bridge saddle members is in contact with an adjacent bridge saddle member and said bridge main body in a plane that is parallel to said direction of said stretched strings, and said saddle adjusting means is provided on said bridge main body, said saddle adjusting means, upon being turned, moves and adjusts said bridge saddle members in said direction of said stretched strings along a surface of contact between said adjacent bridge saddle member and said bridge main body.

2. The tailpiece according to claim 1, wherein said saddle adjusting means is a screw that has a hexagonal groove therein.

3. The tail piece of a string musical instrument according to claim 1, at least one of said plurality of bridge saddle members supports only one of said stretched strings and at least one of said plurality of bridge saddle members supports at least two of said stretched strings.

4. The tail piece of a string musical instrument according to claim 3, wherein said one of said plurality of said bridge saddle members that supports at least two stretched strings has only one saddle adjusting means.

5. The tail piece of a string musical instrument according to claim 4, wherein said saddle adjusting means is one screw.

6. The tail piece of a string musical instrument according to claim 3, wherein a front surface of said one of said plurality of bridge saddle members that supports at least two stretched strings supports is slanted with reference to a direction of said stretched strings.

7. A stringed musical instrument comprising:

a main body;

a neck provided at one end of said main body;

a plurality of strings stretched on said neck and main body;

tuning pegs provided on said neck to hold respectively one end of each one of said strings;

a tailpiece provided on said main body to hold another end of each one of said strings; and stud screws provided on said main body to hold said tailpiece on said main body; wherein said tailpiece is comprised of:

a bridge main body which is formed with engagement portions engaging with said stud screws and is moved in a direction of said stretched strings and secured on said main body; and a plurality of bridge saddle members provided on said bridge main body for supporting said strings, each of said bridge saddle members being in contact with an adjacent bridge saddle member and said bridge main body in a plane that is parallel to said direction of said stretched strings and being moved in said direction of said stretched strings and secured on said bridge main body.

8. The stringed musical instrument according to claim 7, wherein said bridge main body and said bridge saddle members are moved and secured by screws that are provided in said bridge main body and manipulated at a location away from said pegs.

* * * * *